US011779098B1

(12) United States Patent
Blake et al.

(10) Patent No.: US 11,779,098 B1
(45) Date of Patent: Oct. 10, 2023

(54) APPARATUS AND METHODS OF REMOVABLY ATTACHING A BAND TO A WEARABLE ELECTRONIC DEVICE

(71) Applicant: Barking Labs Corp., New York, NY (US)

(72) Inventors: Robert J. Blake, Purchase, NY (US); Shiann S Yamin, Warren, NJ (US); Aaron H. Sirken, Brooklyn, NY (US); Aaron B. Size, Waltham, MA (US); Jonathan R. Bensamoun, New York, NY (US)

(73) Assignee: Barking Labs Corp., New York, NY (US)

( * ) Notice: Subject to any disclaimer, the term of this patent is extended or adjusted under 35 U.S.C. 154(b) by 0 days.

(21) Appl. No.: 18/054,779

(22) Filed: Nov. 11, 2022

(51) Int. Cl.
*A44B 11/25* (2006.01)
*A45F 5/00* (2006.01)

(52) U.S. Cl.
CPC ..... *A45F 5/00* (2013.01)

(58) Field of Classification Search
CPC ..... A44B 11/2596; A44D 2203/00; Y10S 24/906; Y10S 24/43; Y10T 24/4718; Y10T 24/4782; Y10T 24/2155
USPC ..... 224/177, 180, 167–168, 171, 172, 174, 224/152, 164, 165
See application file for complete search history.

(56) References Cited

U.S. PATENT DOCUMENTS 1,776,892 A * 9/1930 Domler ..... A44C 5/2042 24/906
1,826,887 A * 10/1931 Kestenman ..... A44C 5/2042 24/906
3,293,714 A * 12/1966 Shafer ..... A44B 11/2596 297/468
3,327,362 A * 6/1967 Bousquet ..... A44B 11/2596 24/DIG. 38
4,231,137 A 11/1980 Fujimoto
4,622,726 A * 11/1986 Nakamura ..... A44C 5/2057 24/663
4,982,581 A * 1/1991 Furuyama ..... A44C 17/0216 63/29.1
5,367,891 A * 11/1994 Furuyama ..... H01F 7/0263 63/3

(Continued)

OTHER PUBLICATIONS

Abdi, WO-2021116560-A1, Jun. 2021. (Year: 2021).*

(Continued)

*Primary Examiner* — Adam J Waggenspack
(74) *Attorney, Agent, or Firm* — COOLEY LLP

(57) ABSTRACT

Embodiments of an apparatus configured to removably attach a band to a wearable electronic device, and method of its use are described herein. In some embodiments, an apparatus includes a coupler removably coupleable to a frame. The coupler includes a body portion and a curved side portion disposed along a side of the body portion. The curved side portion defines a channel configured to slidingly receive an elongated post of the frame. The body portion of the coupler and the curved side portion of the coupler collectively have an end profile that the prevents insertion of the elongated post of the frame into the channel unless the body portion of the coupler is positioned at an angle within the range of about 5 degrees to about 80 degrees with respect to the frame.

20 Claims, 9 Drawing Sheets

(56) References Cited

U.S. PATENT DOCUMENTS

| | | | | |
|---|---|---|---|---|
| 8,808,104 | B2 * | 8/2014 | Foster | A63B 53/02 473/307 |
| 10,182,623 | B2 * | 1/2019 | Perkins | A44B 11/263 |
| 10,945,476 | B2 * | 3/2021 | Huang | A44B 11/2588 |
| 11,375,778 | B1 * | 7/2022 | Zinnbauer | A44B 11/2596 |

OTHER PUBLICATIONS

[Author Unknown] "Change your Apple Watch Band", Internet: Apple Support downloaded from https://support.apple.com/en-us/HT204818 on Sep. 16, 2022, 5 pages.

* cited by examiner

APPARATUS AND METHODS OF REMOVABLY ATTACHING A BAND TO A WEARABLE ELECTRONIC DEVICE

CROSS-REFERENCE TO RELATED APPLICATION(S)

This application is related to U.S. patent application Ser. No. 18/054,808, entitled "Apparatus and Methods for Wireless Communications Antenna Included Within a Wearable Electronic Device," and filed herewith, the entirety of which is incorporated by reference herein.

BACKGROUND

The embodiments described herein relate generally to apparatus and methods of removably attaching a band to a wearable device, and more particularly related to a coupler configured to removably and securely attach to a frame of a wearable electronic device, and methods of its use.

Known couplers for bands of wearable electronic devices include couplers that are fixedly attached to or non-removably incorporated into a frame of the wearable electronic device. Thus, the coupler itself is not removable from the device.

Other known couplers are configured to be removably coupled to a wearable electronic device by sliding the coupler in a first direction onto the device frame. With such known couplers, the coupler is in substantially the same orientation with respect to the device when the band is being coupled to the device as when the device and band are worn by a user. As such, these known couplers are more easily inadvertently uncoupled or detached from the device, such as in instances where the coupler is inadvertently moved in a second direction opposite the first direction. This can result in loss or breakage (e.g., due to being dropped) of the device.

Thus, a need exists for apparatus and methods configured to removably and securely attach a band to a wearable (e.g., electronic) device.

SUMMARY

Embodiments of an apparatus configured to removably attach a band to a wearable electronic device, and method of its use are described herein. In some embodiments, an apparatus includes a coupler removably coupleable to a frame. The coupler includes a body portion and a curved side portion disposed along a side of the body portion. The curved side portion defines a channel configured to slidingly receive an elongated post of the frame. The body portion of the coupler and the curved side portion of the coupler collectively have an end profile that the prevents insertion of the elongated post of the frame into the channel unless the body portion of the coupler is positioned at an angle within the range of about 5 degrees to about 80 degrees with respect to the frame.

DETAILED DESCRIPTION

Embodiments of an apparatus configured to removably attach a band to a wearable device, and more specifically to a wearable electronic device, and methods of its use are described herein.

The apparatus described herein can be used, for example, to couple a band to a wearable device, and more specifically for attaching a band to a wearable electronic device, such as an electronic pet- or animal-collar. Even more specifically, in some embodiments, the wearable electronic device can be a dog collar, such as an electronic dog collar. The electronic dog collar can be configured to monitor a geo-location of the dog and to transmit information associated with the dog's location to an electronic device (such as a smartphone, computer, or the like). In another example, the apparatus described herein can also or alternatively be used to attach a band to a watch or smartwatch, a fitness tracker, or other suitable wearable electronic device.

Figure 1:
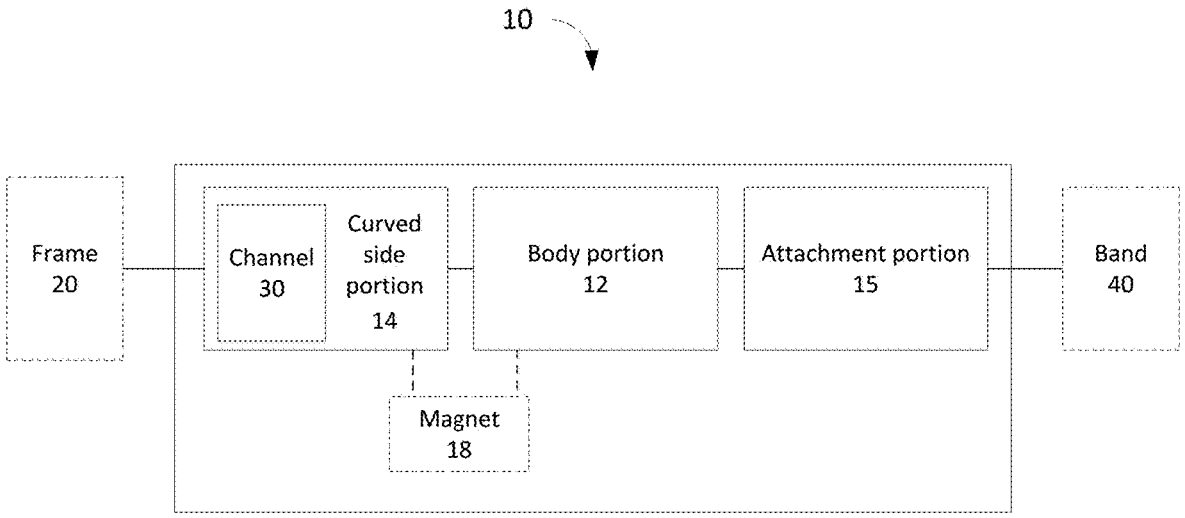
FIG. 1 is a schematic illustration of an apparatus, according to an embodiment.
Figure 2:
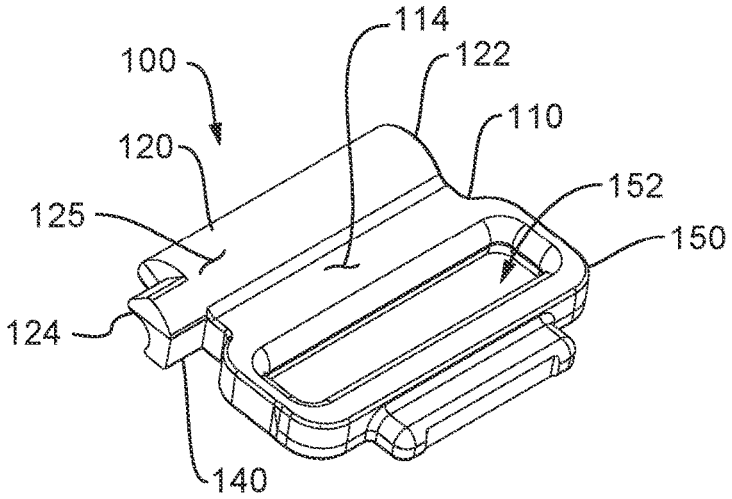
FIG. 2 is a perspective view of an apparatus, according to an embodiment.

An apparatus 10 according to an embodiment is schematically illustrated in FIG. 1. The apparatus 10 can be, for example, a coupler removably coupleable to a frame 20

(e.g., of a wearable electronic device). As such, the coupler 10 can be configured, for example, to removably or reversibly attach a band 40 to the frame 20. The coupler 10 includes a body portion 12 and a curved side portion 14 disposed on or along a side (e.g., a first side) of the body portion 12. The coupler 10 can also include an attachment portion 15 disposed on a side (e.g., second, or opposite, side) of the body portion 12. The body portion 12 can include a surface that is substantially planar. In some embodiments, a portion of the surface can be complementary to a surface portion of the frame 20.

The coupler 10 can include a magnet 18 coupled to the body portion 12 and/or the curved side portion 14. The magnet 18 can be coupled to a recess defined by the body portion 12. The magnet 18 can be configured to help retain the coupler 10 to the frame 20, resist decoupling of the coupler 10 and the frame 20, and/or provide a magnetic force that affects an angle (or position) of the coupler with respect to the frame (e.g., by retaining the coupler 10 in a first position absent a threshold rotational force, or by repelling the coupler 10 from the first position to or towards a second position different from the first position).

The curved side portion 14 of the coupler 10 defines a channel 30. The channel 30 is configured to removably receive a portion of the frame 20 therein. For example, the curved side portion 14 can be a substantially semi-cylindrical or C-shaped extension from a side of the body portion 12, and the channel can be a semi-cylindrical or C-shaped convex curvature defined along a length of the curved side portion 14. The channel 30 is sized and shaped to slidingly receive therein a coupler of the frame 20. For example, in some embodiments, the frame 20 can include a coupler, and the channel 30 of the coupler 10 is configured to removably receive the coupler therein. In some embodiments, the channel 30 includes a first portion having a first size and/or cross-sectional shape and a second portion having a second size and/or cross-sectional shape, where at least one of the second size and/or cross-sectional shape is different from at least one of the first size and/or cross-sectional shape. Each of the first portion and/or the second portion of the channel 30 can have a size and/or shape that is complementary to a size and/or shape of a portion of the frame coupler configured to be received therein when the coupler is fully received or inserted into the channel 30. The curved side portion 14 terminates in an end face disposed on a side of the channel 30 opposite the body portion 12. The end face can have a shape that is complementary to a surface portion of the frame 20, when the coupler 10 and frame 20 are properly aligned for coupling.

The body portion 12 of the coupler 10 and the curved side portion 14 of the coupler 10 collectively have an end profile that prevents or limits insertion of the frame coupler into the channel 30 unless the body portion 12 of the coupler 10 is positioned at an angle (e.g., a predetermined angle) with respect to the frame. The angle at which the body portion 12 of the coupler 10 is positioned with respect to the frame can be defined, for example, by an intersection between a theoretical plane of a first surface of the body portion 12 and a theoretical horizontal plane of the frame that lies along a longitudinal axis of the coupler of the frame. Portions of the end profile of the coupler 10 can be configured to complement the shape of a portion of an end profile of the frame 20 that includes the frame coupler and first and second surface portions of the coupler 10. The angle at which the body portion 12 of the coupler 10 is positioned with respect to the frame 20 to receive the coupler of the frame is less than 90 degrees. For example, in some embodiments, the angle is within the range of about 5 degrees to about 80 degrees with respect to the frame 20 within the range of about 30 degrees to about 70 degrees, within the range of about 40 degrees to about 60 degrees, or within the range of about 50 degrees or about 55 degrees.

The magnet 18 can be configured such that, when the frame coupler is partially inserted into the channel 30, the magnet attracts the frame (e.g., a magnetic portion of or a magnet coupled to the frame) in a manner that helps move the frame coupler within the channel 30 towards a fully inserted position. The magnet 18 can also or alternatively be configured to retain the coupler 10 in a first (or coupled) position with respect to the frame 20 (e.g., in which the coupler is fully inserted within the channel 30) absent a threshold translational force sufficient to overcome the magnetic force to separate the frame coupler from the channel 30 of the coupler 10.

The coupler 10 is configured to rotate with respect to the frame coupler, when the frame coupler is fully inserted in the channel 30 (e.g., in a first position). For example, the coupler 10 can rotate in a first direction with respect to the frame 20 from the first position to a second position or a third position between the first position and the second position, and in a direction from the second position to or towards the first position. The coupler 10 can be rotatable about the frame coupler from the first position to the second position only when the frame coupler is fully inserted (or received) into the channel 30. For example, the coupler 10 and the frame 20 can be cooperatively configured to prevent or limit rotation of the coupler 10 about the frame coupler when the frame coupler is only partially inserted into the channel 30. More specifically, in some embodiments, the end face of the coupler 10 can engage or contact a surface portion of the frame if rotation of the coupler is attempted when the elongated post is only partially, but not fully, inserted in the channel 30. Thus, the engagement or contact of the end face of the coupler 10 and surface portion of the frame 20 cooperatively substantially prevents rotation of the coupler 10 with respect to the frame 20. In some embodiments, the frame 20 can include a keyed element (e.g., a cross-bar, protrusion, or other suitable key feature) configured to be aligned with or received in a portion (e.g., a cut-out portion) of the coupler 10 when the frame coupler is in a fully inserted position in the channel 30. The coupler 10 can be rotatable with respect to the frame coupler when the keyed element is received in, or otherwise aligned with, the cut-out portion of the coupler 10.

The coupler 10 and the frame 20 can be cooperatively configured to prevent or limit removal of the frame's coupler from the channel 30 when the coupler 10 is in the second (or rotated) position. In some embodiments, the coupler 10 and the frame 20 are cooperatively configured to prevent removal of the frame's coupler (or elongated post) from the channel 30 when the coupler 10 is in any substantially any position (e.g., the third position) other than the first position.

Rotation of the coupler 10 with respect to the frame 20 from the first position in which the body portion 12 is at a first angle with respect to the frame 20 to the second position disposes the body portion 12 of the coupler 10 at a different (e.g., second) angle with respect to the frame (also referred to herein as a second or rotated angle). The second angle is greater than the first angle. For example, the second angle can be greater than about 90 degrees, at least about 120 degrees and/or up to about 180 degrees, or about 150 degrees to about 170 degrees. In some embodiments, the second angle is greater than the first angle by about 90 degrees, or by up to about 150 degrees. More specifically, the second angle can be about 170 degrees, or about 115 degrees greater than the first angle.

Although the first, second and third positions of the coupler 10 have been described herein based on an angle defined by an intersection between a theoretical plane of the first surface of the body portion 12 of the coupler 10 and a theoretical horizontal plane of the frame 20 that lies along a longitudinal axis of the frame coupler, in some embodiments, the angle between the body portion 12 of the coupler 10 and the frame 20 can be differently defined. For example, in some embodiments, an angle between the coupler 10 and the frame 20 is an angle between the surface portion of the body portion 12 of the coupler 10 and the first (e.g., complementary) surface of the frame 20 that is in contact with the surface portion of the body portion 12 when the frame coupler is fully received in the channel 30. As such, in some embodiments, when the coupler 10 is in the first position, the first angle between the surface portion of the body portion 12 of the coupler and the first surface of the frame 20 is about zero (0) degrees. When the coupler 10 is in the second position, the second angle between the surface portion of the body portion 12 and the first surface of the frame 20 is greater than the first angle, and more specifically can be more than 90 degrees greater (e.g., about 100 degrees to about 180 degrees greater). In a more specific example, the second angle can be within the range of about 110 degrees to about 130 degrees, and still more specifically about 115 degrees. When the coupler 10 is in the third position between the first position and the second position, the third angle between the surface portion of the body portion 12 of the coupler 10 and the first surface of the frame 20 is greater than the first angle and less than the second angle, and can be about 90 degrees.

As described herein, the coupler 10 can include an attachment portion 15 that is attachable, removably or fixedly, to the band 40 (e.g., a band of an animal collar, such as an electronic dog collar, a watchband, or the like). The attachment portion 15 can define an opening through which the band is or can be removably or non-removably looped. In other embodiments, the attachment portion 15 can be configured to be attached to the band 40 using any suitable fastener.

An apparatus 100 according to an embodiment is illustrated in FIGS. 2-5. The apparatus 100 can be, for example, a coupler removably coupleable to a frame (e.g., of a wearable electronic device) (not shown in FIGS. 2-5). As such, the apparatus (or coupler) 100 can be configured, for example, to removably or reversibly attach a band (not shown in FIGS. 2-5) to the frame (e.g., of the wearable electronic device). By way of example, and not limitation, referring to FIG. 17, the apparatus 100 can be included in a wearable electronic device assembly 200 according to an embodiment, in which assembly 200 also includes an electronics module 300, a band 400, and a second apparatus (or coupler) 101. The second apparatus 101, also shown in FIGS. 6-7 and 9-16, is a mirror image of the apparatus 100, and thus includes substantially identical (though mirror-imaged) features as apparatus 100 and so is not described in detail herein.

The coupler 100 includes a body portion 110 and a curved side portion 120 disposed along a side (e.g., a first side) of the body portion 110. The coupler 100 can also include an attachment portion 150 disposed on a side of the body portion, for example, on a second side of the body portion 110 opposite the side along which the curved side portion 120 is disposed. As such, the attachment portion 150, which is described in more detail herein, and the curved side portion 120 (and thus also channel 130) can be on opposing sides of the body portion 110.

The body portion 110 includes a first surface 112 and a second surface 114 opposite the first surface. At least a portion of the first surface 112 and/or the second surface 114 of the body portion 110 can be substantially planar. In some embodiments, the body portion 110 includes a portion of the first surface 112 (e.g., a surface portion) that is adjacent to or disposed on a first side of a channel 130 defined by the curved side portion 130, and which can be substantially planar. In some embodiments, the surface portion, or another portion of the first surface 112 or a portion of the second surface 114, can be complementary to a first surface portion of the frame, as described in more detail herein.

The coupler 100 can include a magnet 108 coupled to the body portion 110. For example, a surface (e.g., the first surface 112) of the body portion 110 can define a recess 116 (see, e.g., FIG. 3), and the magnet 108 can be at least partially disposed in the recess 116 (see, e.g., FIG. 4). As will be described in more detail herein, the magnet 108 can be configured to help couple the coupler 100 to a frame and/or to provide a magnetic force that affects an angle (or position) of the coupler with respect to the frame.

The curved side portion 120 of the coupler 100 defines a channel 130. More specifically, the curved side portion 120 can extend from or be disposed on (or coupled to) a side of the body portion 110 such that a first surface 123 of the curved side portion 120 defines the channel 130 and such that a second surface 125 of the curved side portion 120, opposite the first surface, has a convex cross-sectional profile (taken along a theoretical plane perpendicular to a longitudinal axis of the curved side portion 120). The channel 130 can have a concave cross-sectional profile (taken along the theoretical plane perpendicular to the longitudinal axis of the curved side portion 120). The curved side portion 120 and/or the channel 130 can each have a substantially C-shaped cross-sectional profile or end profile (e.g., when viewed from one or both ends 122, 124 of the channel 130). In this manner, the curved side portion 120 can be substantially semi-cylindrical and can extend adjacent and along a length of the side of the body portion 110 of the coupler 100.

Figure 3:
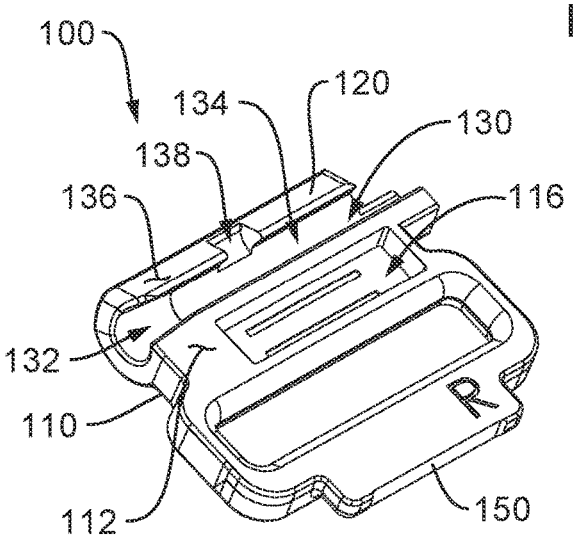
FIG. 3 is a bottom perspective view of the apparatus of FIG. 1.
Figure 4:
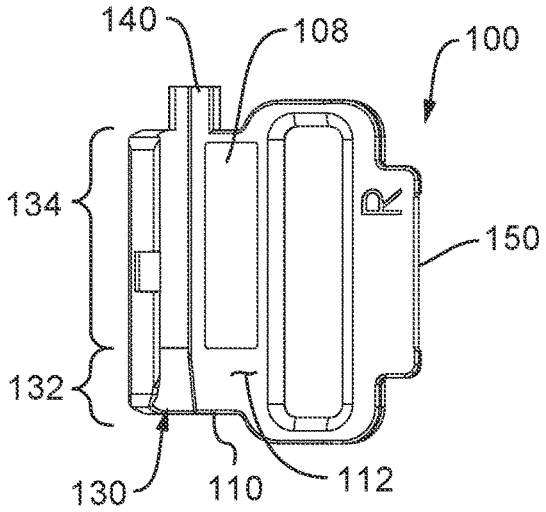
FIG. 4 is a bottom view of the apparatus of FIG. 1.

On either side of the channel 130, portions of the first surface 123 of the curved side portion 120 can be substantially planar (though a portion of the first surface 123 to a first side of the channel 130 and a portion of the first surface 123 to a second side of the channel 130 can be off-set or non-parallel from each other). The channel 130 can be extended (e.g., disposed, formed, or defined) substantially along a length of the curved side portion 120, for example from a first end 122 of the curved side portion 120 to a second end 124, opposite the first end, of the curved side portion 120, as shown in FIGS. 3-4. The channel 130 is sized and shaped to slidingly receive therein a coupler of a frame (e.g., a frame 310, shown in FIG. 7, of the electronics module 300). For example, in some embodiments, a coupler 320 of the frame 310 can be or include an elongated post, and the channel 130 of the coupler 100 is configured to receive the elongated post 320 therein. In some embodiments, the coupler 100 is configured to be moved in the direction of arrow AR0 (FIG. 7) to slidingly couple and uncouple the coupler 100 and the frame 310.

Figure 9:
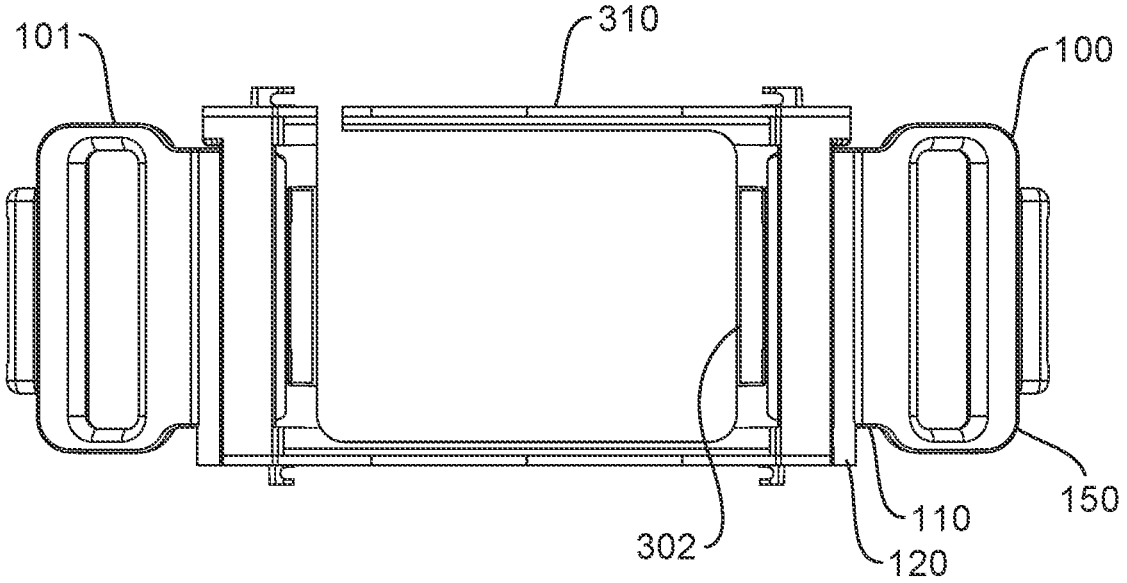
FIG. 9 is a top view of the apparatus of FIG. 2 coupled to the frame of FIG. 7.
Figure 10:
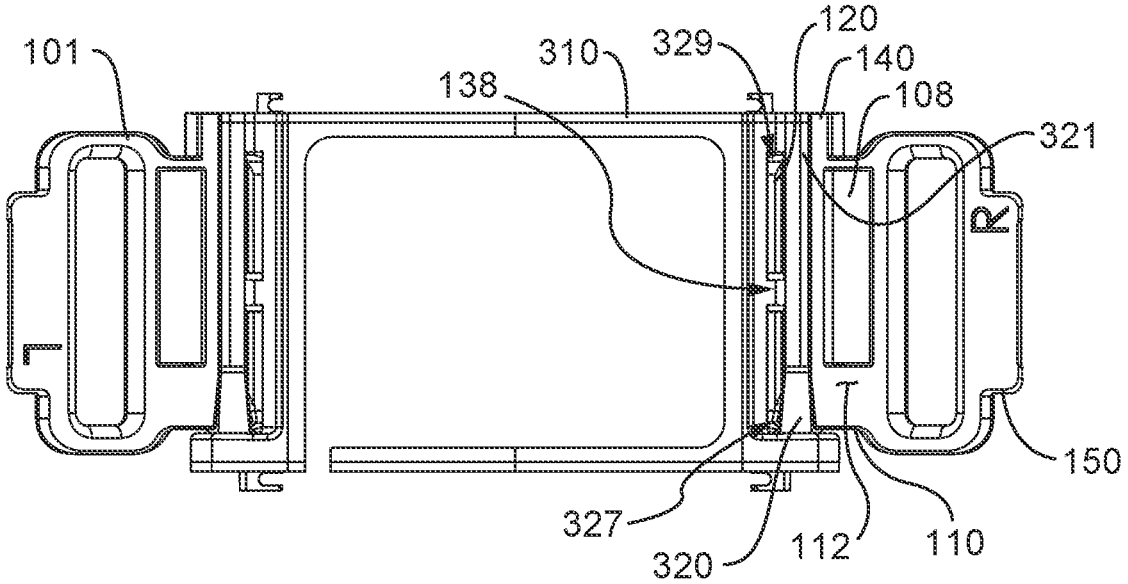
FIG. 10 is a bottom view of the apparatus of FIG. 2 coupled to the frame of FIG. 7.

In some embodiments, at least a portion (e.g., a first portion) of the curved side portion 120 defining the channel 130 has a dimension (e.g., length or width) that is different than another portion (e.g., a second portion) of the curved side portion 120 defining the channel. For example, the "free" end of the curved side portion can have a width (taken in the direction from the first end 122 to the second end 124) that is less than a width of a portion of the curved side portion immediately adjacent the body portion 110. The portion of the curved side portion 120 immediately adjacent the body portion 110 can include a protrusion 140 that is extended beyond a side of the body portion. The open "shoulder" area between the protrusion and the second portion of the curved side portion 120 (which includes the "free" end thereof) is configured to be matingly disposed against a portion 311 of the frame 310 adjacent a first end 321 of the coupler 320, when the coupler 100 is in a second or rotated position (described in more detail herein) with respect to the frame. Thus, an end of the protrusion 140 can be configured to be substantially flush with an end of the frame 310 when the coupler 320 is fully received in the channel 130 (as shown in FIGS. 9-10).

Figure 5:
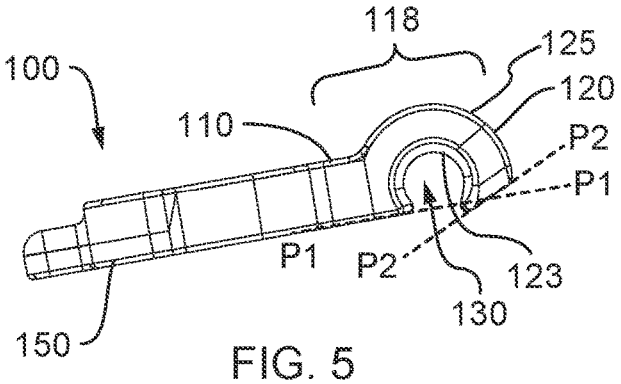
FIG. 5 is a side view of the apparatus of FIG. 1.
Figure 6:
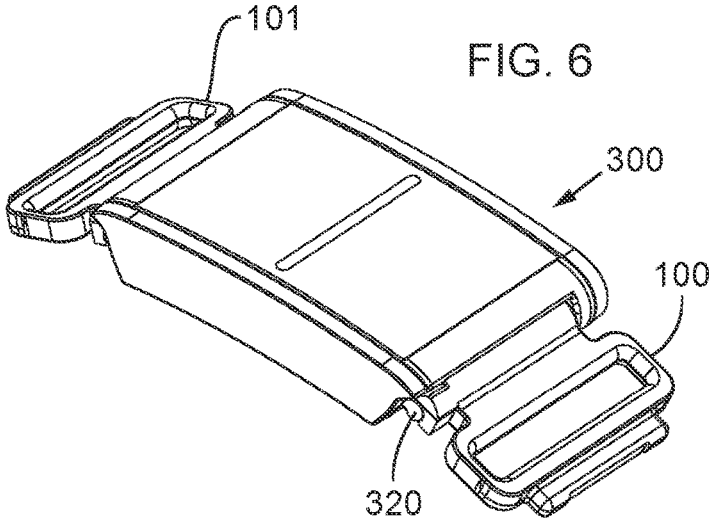
FIG. 6 is a perspective view of the apparatus of FIG. 2 coupled to an electronics module of according to an embodiment.
Figure 7:
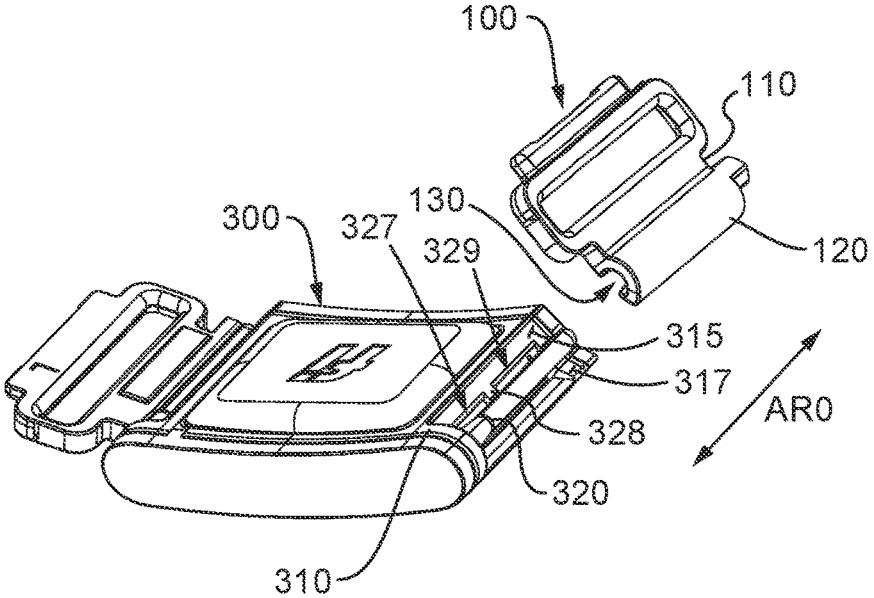
FIG. 7 is a bottom perspective view of the apparatus of FIG. 2 separated from the electronics module of FIG. 6.
Figure 8:
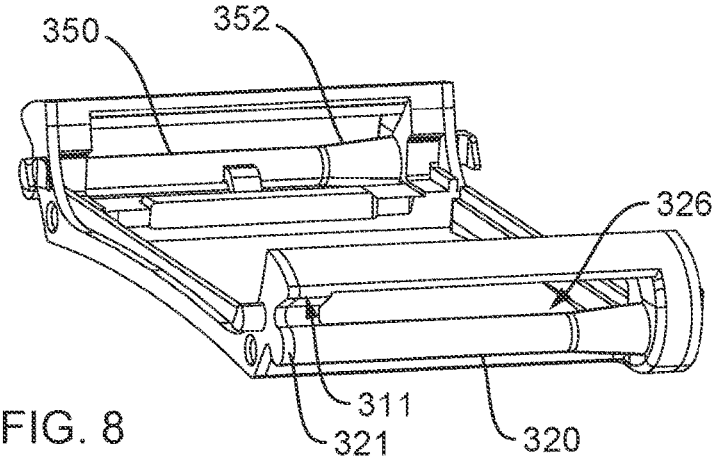
FIG. 8 is a perspective view of a frame of the electronics module of FIG. 6, according to an embodiment.

The curved side portion 120 terminates in an end face 136, which is disposed on a second side of the channel 130 opposite the first side of the channel. Said another way, the "free" end of the C-shaped profile can include the end face 136. The end face 136 can have a shape that is complementary to a second surface portion 317 (see, e.g., FIG. 7) of the frame 310. For example, the end face 136 can be substantially planar, and can be complementary to a substantially planar second surface portion 317 of the frame 310, at least when the coupler 100 is being slidingly coupled to the frame 310 or is in a first position, described in detail herein, with respect to the frame 310. In some embodiments, a theoretical plane on the surface portion of the body portion 110 disposed on the first side of the channel 130, represented by line P1 in FIG. 5, is non-parallel with a theoretical plane on the end face 136 of the curved side portion 120, represented by line P2 in FIG. 5.

Each of couplers 100, 101 can be dedicated for use on a predetermined side or end of the frame 310 of the electronics module 300. Though the C-shaped profile of the curved side portion 120 of the coupler is complementary to an end profile a portion of the frame 310 including the coupler 320 (also referred to herein as the "first coupler"), the C-shaped profile can also be complementary to an end profile of a second coupler 350 of a second portion or side of the frame 310 (see, e.g., the substantially mirror image end profiles of the frame 310 in FIGS. 11-16). Thus, in some embodiments, the coupler 100 and the frame 310 are cooperatively configured to prevent inadvertent coupling of the coupler 100 to the second coupler 350 of the frame 310 in an inverted orientation or the coupler 101 to the first coupler 320 of the frame 310 in an inverted orientation.

For example, in some embodiments, a first portion 132 of the channel 130 of the coupler 100 can be differently shaped than a second portion 134 of the channel. For example, as shown in FIGS. 3-4, in some embodiments, the first portion 132 of the channel 130 is substantially conical and the second portion 134 of the channel 130 is substantially cylindrical. In this manner, the first portion 132 of the channel can be configured to receive a complementary shaped portion of the coupler of the frame 310 (e.g., a conical portion 322 of the coupler 320, or more specifically of the elongated post of the frame), such as when the coupler of the frame is substantially fully inserted into the channel 130 in a predetermined orientation. In such embodiments, the second portion 134 of the channel 130 can be mutually exclusive of the first portion 132 of the channel 130.

The complementary conical portions 132, 322 of the coupler 100 and the frame 310, respectively, cooperatively help to prevent the coupler 100, 101 from being coupled to the opposing, or incorrect, side of the electronics module 300. More specifically, if the coupler 100 is slidingly translated on the second coupler 350 of the frame instead of the first coupler 320 and in an inverted orientation, the conical portion 352 of the frame's coupler 350 will prevent the second, substantially cylindrical, portion 134 of the channel 130 of coupler 100 from fully receiving the conical portion 352 of the coupler 350 therein because the conical portion 352 of the second coupler 350 is wider than the second, substantially cylindrical, portion 134 of the channel 130. Said another way, the coupler 350 of a second side of frame 310 can be partially but not fully inserted into the channel 130 of the coupler 100 configured to be coupled to the coupler 320 of a first side of the frame 310, and vice versa with respect to coupler 320 of the frame 310 and coupler 101.

Figure 11:
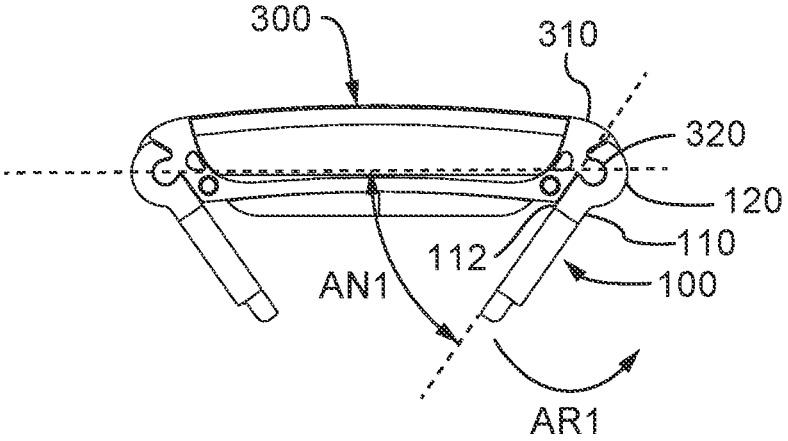
FIG. 11 is a side view of the apparatus of FIG. 2 coupled to the electronics module of FIG. 6, in a first configuration.
Figure 12:
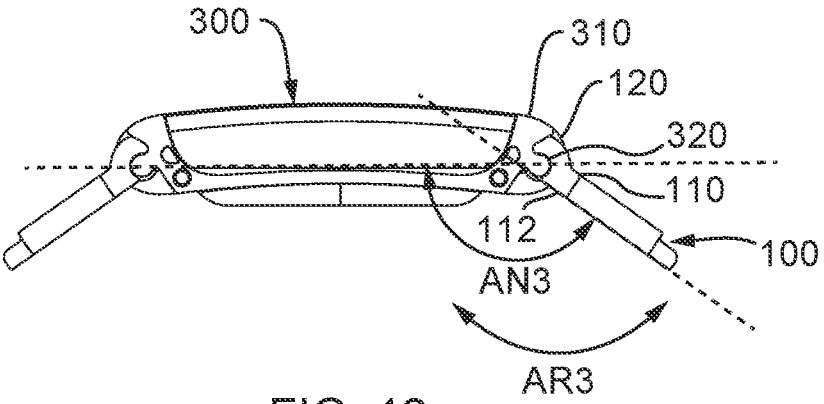
FIG. 12 is a side view of the apparatus of FIG. 2 coupled to the electronics module of FIG. 6, in a second configuration.
Figure 13:
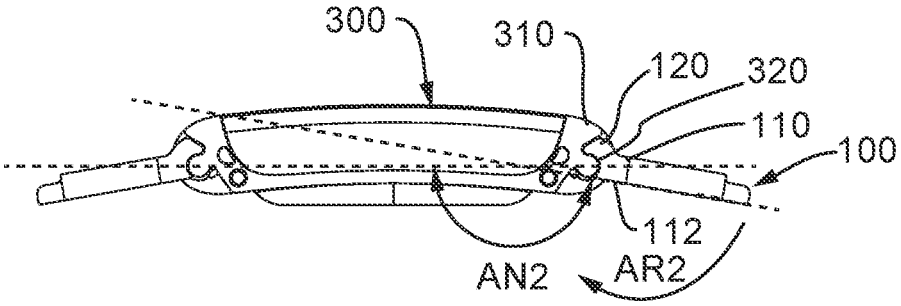
FIG. 13 is a side view of the apparatus of FIG. 2 coupled to the electronics module of FIG. 6, in a third configuration.

The body portion 110 of the coupler 100 and the curved side portion 120 of the coupler 100 collectively have an end profile 118 (see, e.g., FIG. 5) that prevents or limits insertion of the coupler of the frame, or more specifically, the elongated post of the frame, into the channel 130 unless the body portion 110 of the coupler 100 is positioned at an angle (e.g., a predetermined angle) with respect to the frame. Referring to FIGS. 11-13, an angle at which the body portion 110 of the coupler 100 is positioned with respect to the frame can be defined, for example, by an intersection between a theoretical plane of the first surface 112 of the body portion 110 and a theoretical horizontal plane of the frame that lies along a longitudinal axis of the coupler (or elongated post) of the frame. Portions of the end profile of the coupler 100 can be configured to complement the shape of a portion of an end profile of the frame 310 that includes the elongated post 320 and first and second surface portions 315, 317.

The angle (represented by angle AN1 in FIG. 11) at which the body portion 110 of the coupler 100 is positioned with respect to the frame 310 to receive the coupler (e.g., the elongated post) 320 of the frame (also referred to herein as a first or coupling angle) is less than 90 degrees. For example, in some embodiments, the first angle is within the range of about 5 degrees to about 80 degrees with respect to the frame 310. More specifically, in some embodiments, the first angle is within the range of about 30 degrees to about 70 degrees. Still more specifically, in some embodiments, the first angle is within the range of about 40 degrees to about 60 degrees. The first angle can be, for example, about 50 degrees or about 55 degrees, as shown in FIG. 11.

In some embodiments, when the coupler 320 of the frame is partially inserted into the channel 130, the magnet 108 is configured to help move the coupler 320 of the frame 310 within the channel 130 towards a fully inserted position. For example, the frame 310 can include a magnet or magnetic portion 302 (e.g., proximate to the coupler 320, or elongated post, of the frame) (see, e.g., FIG. 9), and the magnet 108 of the coupler 100 can be configured to attract the magnet 302 coupled to (or magnetic portion of) the frame 310, thereby moving the elongated post 320 of the frame 310 through the channel 130 from a partially inserted position (not shown) to a fully inserted position (as shown in FIGS. 9-10). More specifically, during insertion of the elongate post (or coupler 320) into the channel 130, when a first portion of the coupler's 100 magnet 108 overlies a first portion of the frame's 310 magnet 302, the collective magnetic attraction force between the magnets 108, 302 acts to move the magnet 302 of the frame towards the magnet 108 of the coupler 100 so that a second, greater, portion (or an entirety) of the magnet 108 overlies or is otherwise aligned with a second, greater, portion of the frame magnet 302, resulting in the elongated post 320 being moved from the partially inserted position to or towards a fully inserted position. The magnet 108 can also or alternatively be configured to retain the coupler 100 in a first (or coupled) position with respect to the frame 310 (e.g., in which the coupler, or elongated post, 320 is fully inserted within the channel 130) absent a threshold translational force sufficient to overcome the magnetic force to separate the coupler 320 of the frame 310 from the channel 130 of the coupler 100. For example, in some embodiments, the magnets 108, 302 can be cooperatively configured to prevent withdrawal of the elongated post 320 from the channel 130 in the absence of the threshold translational force.

The coupler 100 is configured to rotate with respect to the coupler (e.g., elongated post) 320 of the frame 310. For example, the coupler 100 can rotate in a first direction, represented by arrow AR1 in FIG. 11, with respect to the frame 310. Said another way, the coupler 100 is rotatable about the coupler 320 of the frame 310 from a first position (i.e., in which the coupler 320 of the frame 310 is fully inserted into the channel 130 of the coupler 100 and the body portion 110 of the coupler 200 is positioned at the first (or coupling) angle with respect to the frame) (shown in FIG. 11) to a second position relative to the coupler in which the body portion 110 is positioned at a second (or rotated) angle with respect to the frame (e.g., shown in FIG. 13).

The coupler 100 can be rotatable about the elongated post (or coupler) 320 of the frame 310 from the first position to the second position only when the coupler (e.g., elongated post) 320 of the frame 310 is fully inserted (or received) into the channel 130. For example, the coupler 100 and the frame 310 can be cooperatively configured to prevent or limit rotation of the coupler 100 about the elongated post 320 when the elongated post is only partially inserted into the channel 130. More specifically, in some embodiments, the end face 136 of the coupler 100 can engage the (e.g., second) surface portion 317 of the frame if rotation of the coupler 100 is attempted when the elongated post 320 is only partially, but not fully, inserted in the channel 130. Thus, the engagement of the end face 136 and surface portion 317 of the frame cooperatively substantially prevents rotation of the coupler 100 with respect to the elongated post 320. The surface portion 317 of the frame 310 can be positioned, for example, at or adjacent a first end 321 of the elongated post 320.

The end face 136 can optionally define a cut-out portion 138 (see FIGS. 3-4) positioned to receive a portion of the frame 310, for example, when the coupler 320 of the frame 310 is fully received in the channel 130. For example, the cut-out portion 138 of the end face 136 can be configured to receive at least a portion of, or otherwise be aligned to receive, an optional bar 328 (e.g., a support bar) of the frame 310 when the elongated post 320 of the frame is in a fully inserted position in the channel 130. The bar 328 of the frame 310 can having a longitudinal axis that is substantially perpendicular to a longitudinal axis of the elongated post 320. The coupler 100 can be rotatable with respect to the coupler (or elongated post) 320 of the frame when the bar 328 of the frame is received in, or otherwise aligned with, the cut-out portion 138. In some embodiments, the bar 328 of the frame is only received in or aligned with the cut-out portion 138 when the coupler of the frame (e.g., the elongated post) is fully received in the channel 130.

When the coupler of the frame (e.g. the elongated post) is partially, but not fully, received in the channel 130, an edge portion of the end face 136 of the curved side portion 120 engages the bar 328 of the frame 310, which thereby helps substantially prevent the coupler 100 from being rotated with respect to the frame. As such, the coupler 100 is not rotatable with respect to the coupler (e.g., the elongated post) 320 of the frame 310 when the bar 328 of the frame is not received in, or otherwise aligned with, the cut-out portion 138. The frame 310 can define elongate slots 327, 329 (see, e.g., FIG. 7) on either side of bar 328, which, upon rotation of the coupler 100 to the second position, receive portions of the "free" end of the C-shaped profile (e.g., portions of the end face on either side of cut-out 138.

The coupler 100 and the frame can be cooperatively configured to prevent or limit removal of the frame's coupler (or elongated post) from the channel 130 when the coupler 100 is in the second (or rotated) position. In some embodiments, the coupler 100 and the frame are cooperatively configured to prevent removal of the frame's coupler (or elongated post) from the channel 130 when the coupler 100 is in any substantially any position (e.g., a third position, as shown in FIG. 12) between the first position of the coupler 100 and the second position of the coupler 100.

For example, in some embodiments, the "free" end of the C-shaped profile of the curved portion 120, which includes the end face 136, can be received in an opening or elongate slot 326 defined by the frame 310 (e.g., between the elongated post 320 and a body portion 318 of the frame). When the coupler 100 is rotated with respect to the elongated post 320, e.g., such that at least a portion of the free end of the curved portion 120 is received in the elongate slot 326, a side portion of the free end of the curved portion 120 engages a surface of the frame 310 (e.g., an inner side surface of the frame that defines the opening or elongate slot 326), thereby preventing translational movement of the coupler with respect to the frame. In this manner, substantially any rotation of the coupler 100 with respect to the frame's coupler 320 acts to secure the coupling or attachment of the coupler 100 and the frame 310. Also in this manner, the coupler 100 is rotated in a second (or reverse) direction (represented by arrow AR2 in FIG. 13), from the second position (or the third position between the second position and the first position) fully to the first position to be able to uncouple the coupler 100 and the frame 310, and does not otherwise uncouple the coupler 100 and the frame 310. When the coupler 100 is in the third position between the first position and the second position, as shown in FIG. 12, the coupler 100 can rotate in each of the first direction or the second direction (represented by arrow AR3 in FIG. 12), but cannot be slidingly translated with respect to the elongated post 320. In the third position, the coupler 100 defines a third angle, represented by angle AN3 in FIG. 12, with respect to the frame. The third angle is greater than the first angle and less than the second angle.

Rotation of the coupler 100 with respect to the frame 310 (or the elongated post 320 of the frame) from the first position to the second position disposes the body portion 110 of the coupler 100 at a different (e.g., second) angle with respect to the frame (also referred to herein as a second or rotated angle), represented by angle AN2 in FIG. 13. The second angle is greater than the first angle. For example, the second angle can be greater than about 90 degrees. In some embodiments, the second angle is greater than the first angle by about 90 degrees. For example, the second angle can be greater than the first angle by up to about 150 degrees. In a further example, the second angle of the body portion 110 of the coupler 100 can be, for example, at least about 120 degrees and/or up to about 180 degrees with respect to the frame. More specifically, as shown in FIG. 13, the second angle can be about 170 degrees, or about 115 degrees greater than the first angle shown in FIG. 11.

In some embodiments, the magnet 108 is positioned to retain the coupler 100 at the first angle relative to the frame 310 in the absence of a threshold rotational force. For example, the magnet 108 of the coupler 100 can be attracted to an adjacent surface of the frame (which can be, e.g., a metal frame). In another example, referring to FIGS. 9-10, the magnet 108 can be positioned near a magnet 302 of the frame 310, with opposing polarity, when the coupler 100 is in its first position, such that the magnets attract each other. As such, a threshold rotational force is used to overcome the magnetic force produced by attraction of the magnets 108, 302 to rotate the coupler 100 with respect to the elongated post 320.

In other embodiments, the magnet 108 can be configured to repel the coupler 100 from frame. More specifically, the magnet 108 can be positioned to repel the body portion 110 of the coupler 100 from the first position (or being disposed at the first angle with respect to the frame 310) and towards the second position (or being at the second angle with respect to the frame 310). The magnet 108 can be positioned near the magnet 302 of the frame 310 when the coupler 100 is in its first position, like shown in FIG. 11, with like polarities of the magnets facing each other so that the magnet 108 repels from the magnet 302 of the frame. In this manner, the magnets 108, 302 can cooperatively help prevent inadvertent rotation of the coupler from the second position (or third position) to the first position, such as when the coupler 100 is in use thereby helping to secure the device to a user.

Although the first, second and third positions of the coupler 100 have been described herein in reference to FIGS. 11-13 based on an angle defined by an intersection between a theoretical plane of the first surface 112 of the body portion 110 of the coupler 100 and a theoretical horizontal plane of the frame 310 that lies along a longitudinal axis of the coupler (or elongated post) of the frame, in some embodiments, the angle between the body portion 110 of the coupler 100 and the frame 310 can be differently defined.

Figure 14:
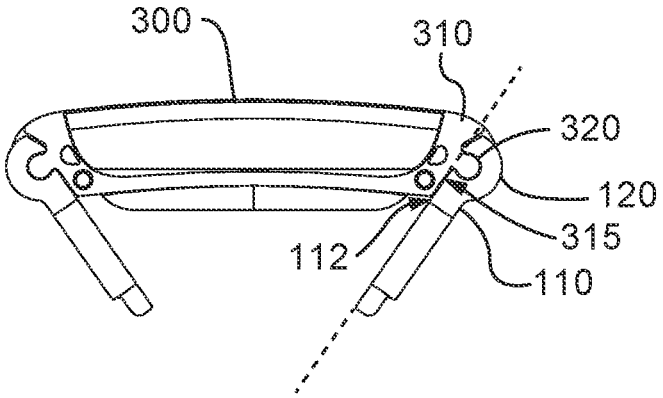
FIG. 14 is a side view of the apparatus of FIG. 2 coupled to the electronics module of FIG. 6, in the first configuration.
Figure 15:
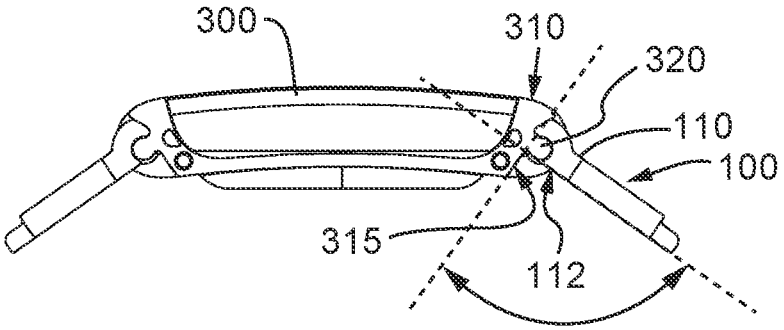
FIG. 15 is a side view of the apparatus of FIG. 2 coupled to the electronics module of FIG. 6, in the second configuration.
Figure 16:
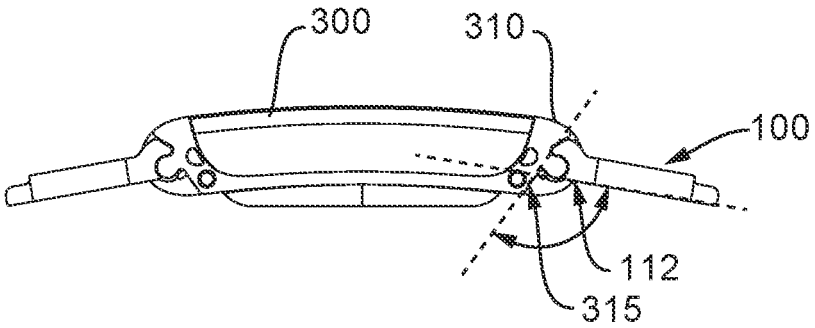
FIG. 16 is a side view of the apparatus of FIG. 2 coupled to the electronics module of FIG. 6, in the third configuration.

For example, referring to FIGS. 14-16, in some embodiments, an angle between the coupler 100 and the frame 310 is an angle between the surface portion 112 of the body portion 110 of the coupler 100 and the first (e.g., complementary) surface 315 of the frame 310. As such, in some embodiments, when the coupler 100 is in the first position, as shown in FIG. 14, the first angle between the surface portion 112 of the body portion 110 of the coupler and the first surface 315 of the frame 310 is about zero (0). When the coupler 100 is in the second position, as shown in FIG. 16, the second angle between the surface 112 of the body portion 110 of the coupler and the first surface 315 of the frame 310 is greater than the first angle, and more specifically can be more than 90 degrees greater such as about 100 degrees to about 180 degrees. In a more specific example, the second angle can be within the range of about 110 degrees to about 130 degrees, and still more specifically about 115 degrees. When the coupler 100 is in the third position, as shown in FIG. 15, between the first position and the second position, the third angle between the surface portion 112 of the body portion 110 of the coupler 100 and the first surface 315 of the frame 310 is greater than the first angle and less than the second angle, and can be about 90 degrees.

Figure 17:
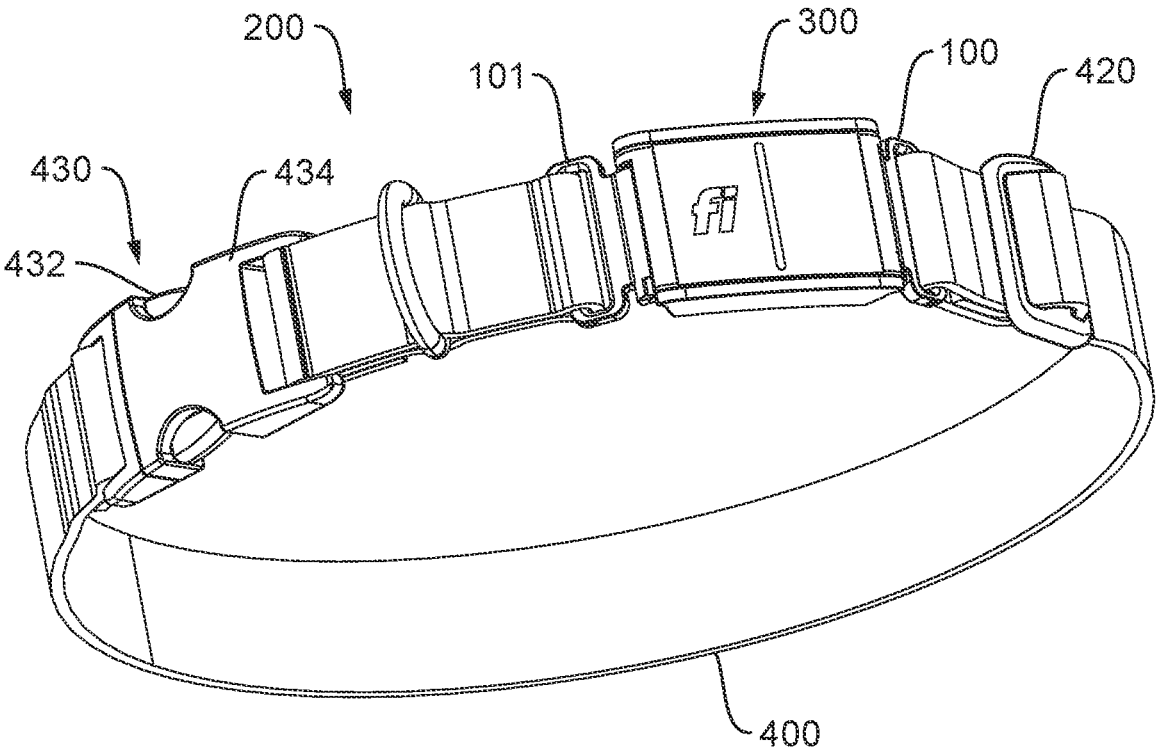
FIG. 17 is a perspective view of a wearable electronic device assembly, according to an embodiment.

As described herein, the coupler 100 can include an attachment portion 150 can be attachable, removably or fixedly, to a band (e.g., a band of an animal collar, a watchband, or the like). The attachment portion 150 can define an opening 152, e.g., through which the band is or can be removably or non-removably looped. As best shown in FIG. 17, the band 400 and couplers 100, 101 collectively are configured to be coupled to the wearable electronic device, and to attach the wearable electronic device to a user. The coupler 100 can be coupled to a first end portion of the band 400 and the coupler 101 can be coupled to a second end portion of the band 400 opposite the first end portion. The band 400 can have an adjustable length. For example, the band can include a ladder lock buckle 420, or the like, disposed between a first end of the band and a second end of the band 400. In another example, the band 400 can be looped through the attachment portion 150 and adjustably coupled back on itself using, for example, a hook and loop fastener, snaps, a buckle, or the like. In some embodiments, the band 400 includes a buckle 430 disposed between the first end portion and the second end portion. The buckle 430 can, for example, include a male portion 432 and a female portion 434 configured to matingly engage with the male portion 432. In this manner, the buckle 430 is configured to open the band 400 of the wearable electronic device for attaching to or donning by a user.

In some embodiments, one or more portions of the couplers described herein (e.g., coupler 10, coupler 100) can be monolithically constructed. For example, body portion 110 can be monolithically formed with one or both of curved side portion 120 and attachment portion 150. In other embodiments, one or more of the body portion 110, curved side portion 120 or attachment portion 150 can be separately formed or constructed and attached to the other of the body portion 110, curved side portion 120 and/or attachment portion 150.

Figure 22:
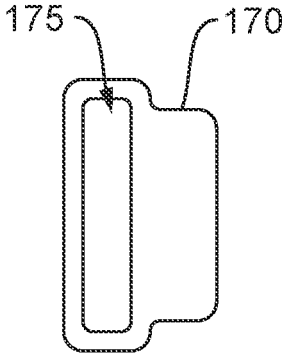
FIG. 22 is a top view of a locking clip, according to an embodiment.

In some embodiments, any of the apparatus described herein can include a locking element (e.g., a clip, stopper, fastener or other suitable locking element) configured to be selectively engaged to prevent rotation of the coupler 100 to the first position when the locking element is engaged. For example, referring to FIG. 19, a clip 160 is coupled to the band 400. The clip 160 can define an elongate slot 165 between a first side portion 162 of the clip and a second side portion 164 of the clip. The elongate slot 165 is sized and shaped for a portion of the band 400 to be disposed therethrough. In some embodiments, a perimeter portion of the clip 160 defines an opening 163 through which the band 400 can be inserted into the elongate slot 165. As such, the clip 160 can be removable from the band 400. In other embodiments, as shown in FIG. 22, a clip 170 can be substantially continuous around a perimeter of the elongate slot 175. In this manner, the clip 160 can be non-removable from the band 400 after the clip is assembled to the band (e.g., a distal end portion of the band 400 can be fed through elongate slot 175 and then sewn, glued, or otherwise attached to a different portion of the band 400).

Figure 19:
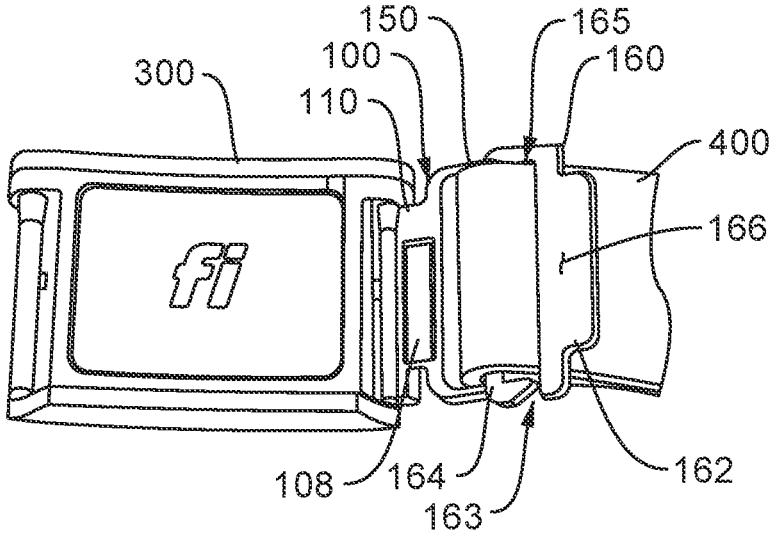
FIG. 19 is a bottom view of the apparatus of FIG. 2 coupled to the electronics module of FIG. 6 and with a locking clip in a first position, according to an embodiment.
Figure 20:
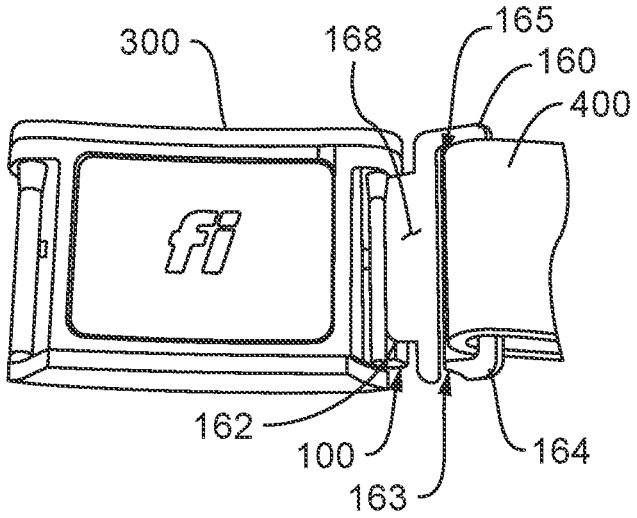
FIG. 20 is a bottom view of the apparatus of FIG. 2 coupled to the electronics module of FIG. 6 and with the locking clip of FIG. 19 in a second position, according to an embodiment.

In use, the clip 160 (or clip 170) is movable from a first position, as shown in FIG. 19, to a second position, as shown in FIG. 20. In the first position, the first side portion 162 of the clip 160 is spaced apart from the coupler 100 and of the second side portion 164 of the clip 160 positioned proximate to the attachment portion 150 of the coupler 100 (e.g., within a looped-back or folded portion of the band 400). More specifically, a first surface (not shown in FIGS. 19-21) of the second side portion 164 of the clip can be positioned in contact with the attachment portion 150 of the coupler 100, when the clip is in the first position.

Figure 21:
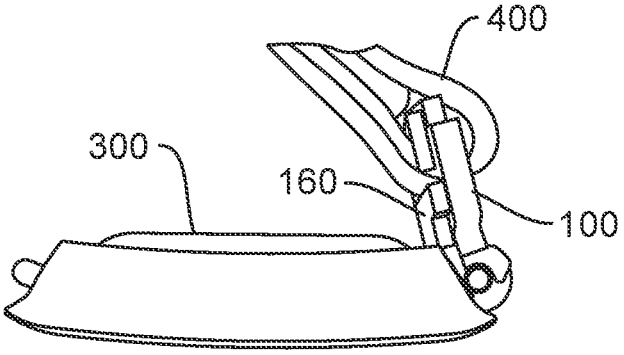
FIG. 21 is a side view of the apparatus of FIG. 2 coupled to the electronics module of FIG. 6 and with the locking clip of FIG. 19 in the second position.

The clip 160 is configured to be rotated by a user from the first position to the second position. In the second position, the first side portion 162 of the clip 160 (e.g., a first surface 166 of the first side portion 162) is in contact with the body portion 110 of the coupler 100 and the second side portion 164 of the clip 160 is positioned proximate to the attachment portion 150 of the coupler 100 (and, in some embodiments, a second surface (not shown in FIGS. 19-21) of the second side portion 164 of the clip, opposite the first surface, is in contact with the attachment portion 150 of the coupler 100). The clip 160, or at least the first side portion 162 thereof, can be at least partially constructed of metal. The first side portion 162 can be coupled to the body portion 110 of the coupler 100, for example, by magnetic attraction of the metal clip 160 to the magnet 108. As shown in FIG. 21, when the coupler 100 is rotated towards its first position, the clip 160 provides a physical barrier that prevents complete rotation to the coupler's first position. In this manner, the clip 160 is configured be selectively engaged to help prevent inadvertent decoupling of the coupler 100 from the electronics module 300. To remove the coupler 100 from the electronics module 300, the clip 160 is moved by a user from the second position to or towards the clip's first position, thereby permitting the coupler 100 to be fully moved to the coupler's first position and subsequently decoupled from the electronics module.

Figure 23:
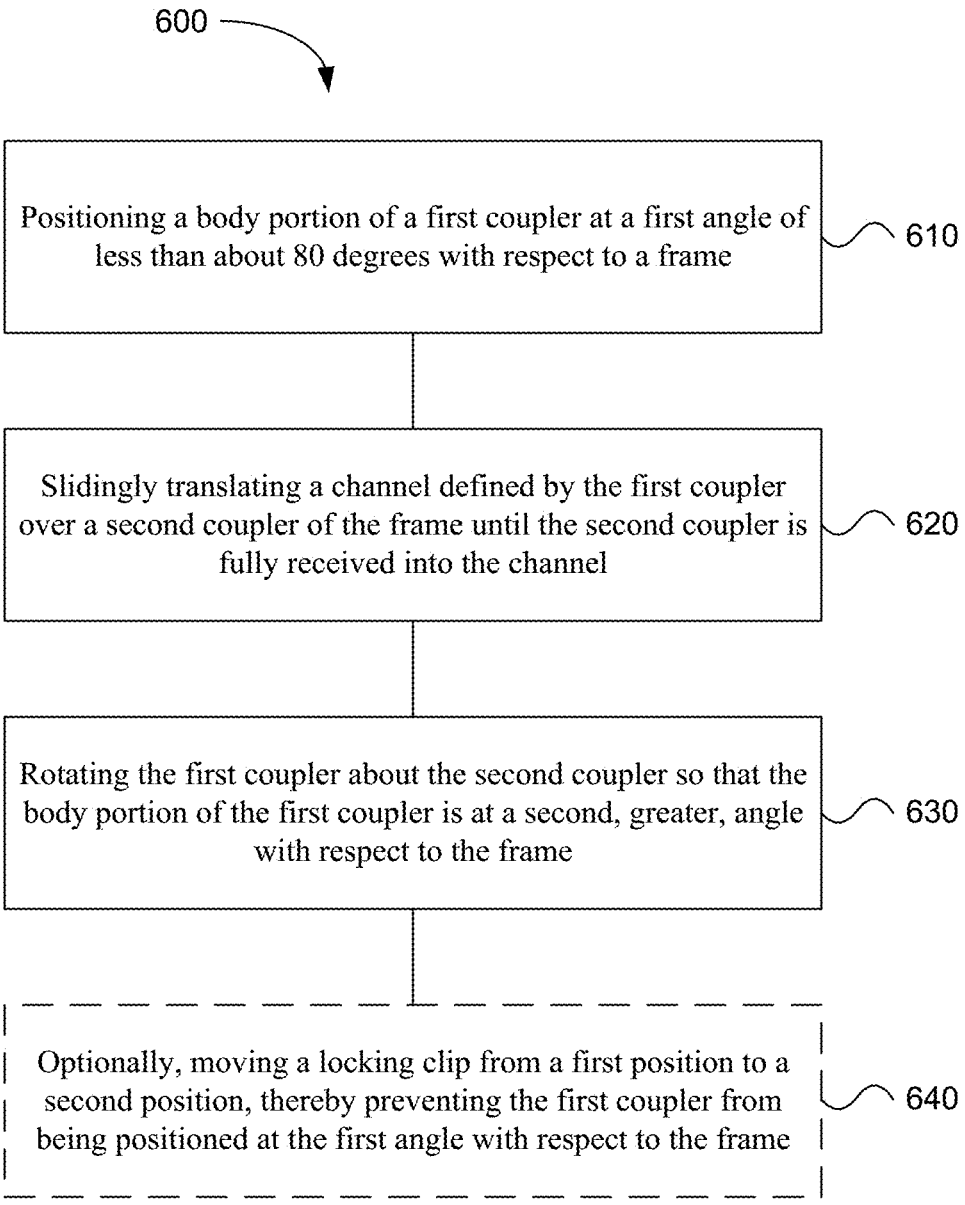
FIG. 23 is a flowchart illustrating a method of using a coupler according to an embodiment.

Referring to FIG. 23, a method 600 according to an embodiment includes, at 610, positioning a body portion (e.g., body portion 110 or any suitable body portion described herein) of a first coupler (e.g., coupler 100, 101, or any coupler described herein) at a first angle with respect to a frame. In some embodiments, the first angle is less than about 80 degrees. The angle can be any of the first angles described herein. For example, the first angle can be within the range of about 30 degrees to about 60 degrees.

At 620, the method includes slidingly translating a channel (e.g., channel 130 or any channel described herein) defined by the first coupler over a second coupler of the frame (e.g., the coupler or elongate post 320 of the frame 310 or any suitable coupler of a frame described herein) until the second coupler is fully received into the channel.

At 630, the method includes rotating the first coupler about the second coupler so that the body portion of the first coupler is at a second angle with respect to the frame. The second angle can be greater than the first angle. The second angle can be any second angle described herein. For example, the rotating can include rotating the first coupler more than 90 degrees and up to about 150 degrees. The first coupler (e.g., coupler 100 or any suitable coupler described herein) is non-removable from the second coupler (e.g., coupler 320 or any suitable coupler described herein) when the body portion is at the second angle with respect to the frame. The first coupler at the first angle can be in a first position, as described herein, and the first coupler at the second angle can be in a second position, as described herein.

In some embodiments, in which at least one of the first coupler or the second coupler includes a magnet configured to retain the body portion at the first angle with respect to the frame, the rotating includes applying a threshold rotational force to overcome a magnetic (attraction) force of the magnet. In other embodiments, at least one of the first coupler or the second coupler is configured to repel the body portion from the first angle towards the second angle. As such, rotating the first coupler about the second coupler in a second direction opposite the rotating direction at 630 can include applying a threshold rotational force to overcome a magnetic (repelling) force of the magnet.

At 640, the method optionally includes moving a locking clip (e.g., clip 160, 170) from a first position to a second position. In the first position, the locking clip does not interfere with rotation of the first coupler with respect to the second coupler. In the second position, the locking clip prevents the first coupler from being positioned at (or returned to) the first angle with respect to the frame. In this manner, the locking clip can be selectively engaged to prevent inadvertent uncoupling of the first coupler from the second coupler, because the first coupler cannot move to the first angle when the locking clip is engaged and the first coupler cannot be removed from the second coupler until the first coupler is in the first position. This can be useful, for example, in an animal collar worn by an active pet whose activity may otherwise cause the coupler to inadvertently detach from the frame.

In some embodiments, the method can optionally include moving the locking clip from the second position to the first position, for example, so that the coupler can be uncoupled from the frame.

In some embodiments, an apparatus includes a coupler that is removably coupleable to a frame. The coupler includes a body portion and a curved side portion disposed along a side of the body portion. The curved side portion defines a channel configured to slidingly receive an elongated post of the frame. The body portion and the curved side portion collectively have an end profile that the prevents insertion of the elongated post of the frame into the channel unless the body portion of the coupler is positioned at an angle within the range of about 5 degrees to about 80 degrees with respect to the frame. In some embodiments, the angle is about 40 degrees to about 60 degrees. In some embodiments, when the elongated post is in a fully inserted position in the channel, the coupler is configured to rotate with respect to the frame and about the elongated post so that the body portion of the coupler is positioned at an angle of at least about 120 degrees and up to about 180 degrees, with respect to the frame.

In some embodiments, an end face of the curved side portion defines a cut-out portion positioned to receive a bar of the frame when the elongated post is in a fully inserted position in the channel. The bar of the frame can be substantially perpendicular to the elongated post. The coupler can be rotatable with respect to the elongated post when the cut-out portion is positioned to receive the bar of the frame portion, and not rotatable with respect to the elongated post when the cut-out portion is not positioned to receive the bar of the frame.

In some embodiments, the angle is a first angle, and the coupler is configured to rotate with respect to the frame and about the elongated post so that the body portion of the coupler is positioned at a second angle with respect to the frame. The second angle can be within the range of about 120 degrees and to about 180 degrees. The apparatus can further include a magnet coupled to the body portion of the coupler. The magnet can be positioned to one of (1) retain the coupler at the first angle relative to the frame in the absence of a threshold rotational force, or (2) repel the body portion of the coupler from being positioned at the first angle with respect to the frame towards the second angle with respect to the frame. In some embodiments, the magnet is configured to attract a magnet coupled to the frame, to help move the elongated post of the frame through the channel to a fully inserted position. The magnets can be collectively configured to prevent withdrawal of the elongated post from the channel in the absence of a threshold translational force.

In some embodiments, a first portion of the channel can be substantially conical and a second portion of the channel can be substantially cylindrical and optionally mutually exclusive of the first portion of the channel. The conical portion of the channel can be configured to receive a conical portion of the elongated post of the frame.

In some embodiments, the body portion includes a surface portion that is complementary to a first surface portion of the frame. The surface portion of the body portion can be disposed on a first side of the channel. The surface portion of the body portion can be substantially planar. In some embodiments, the curved side portion of the coupler terminates in an end face, which can be complementary to a second surface portion of the frame. The end face can be disposed on a second side of the channel opposite the first side. The end face can be substantially planar. The surface portion of the body portion can be non-parallel with the end face of the curved side portion. In some embodiments, the frame is a frame of a wearable electronic device and the side of the body portion is a first side; the coupler also includes an attachment portion disposed on a second side of the body portion. The attachment portion can be configured to be attached to a band.

In some embodiments, an apparatus includes a first coupler that has a body portion and that defines a channel configured to removably receive a second coupler of a frame when the first coupler is in a first position relative to the second coupler. The body portion is positioned at a first angle with respect to the frame when the first coupler is in the first position. The first coupler is rotatable about the second coupler of the frame from the first position to a second position relative to the second coupler. The body portion is positioned at a second angle with respect to the frame when the first coupler is in the second position. The first coupler and the frame are cooperatively configured to prevent removal of the second coupler from the channel when the first coupler is in the second position. The first coupler includes a magnet coupled to the body portion. The magnet is configured to one of (1) retain the first coupler in the first position absent a threshold rotational force to move the first coupler to the second position, or (2) repel the first coupler from the first position towards the second position.

In some embodiments, the first coupler is rotatable about the second coupler to the second position only when the second coupler is fully inserted into the channel. In some embodiments, the magnet is configured to retain the first coupler in the first position absent a threshold translational force to separate the second coupler from the channel of the first coupler.

In some embodiments, the first angle is within the range of about 40 degrees to about 60 degrees. In some embodiments, the second angle is greater than the first angle and up to about 180 degrees. In some embodiments, a first portion of the channel is substantially conical and a second portion of the channel is substantially cylindrical and mutually exclusive of the first portion of the channel. The conical portion of the channel can be configured to receive a conical portion of the second coupler when the second coupler is fully inserted into the channel.

The frame can be included in a wearable electronic device. The first coupler can include an attachment portion on a side of the body portion opposite the channel, and the attachment portion can be configured to be attached to a band for wearing the wearable electronic device.

In some embodiments, a method includes positioning a body portion of a first coupler at a first angle with respect to a frame. The first angle is less than about 80 degrees. The method also includes slidingly translating a channel defined by the first coupler over a second coupler of the frame until the second coupler is fully received into the channel. The method further includes rotating the first coupler about the second coupler so that the body portion of the first coupler is at a second angle with respect to the frame. The second angle is greater than the first angle. The first coupler is non-removable from the second coupler when the body portion is at the second angle with respect to the frame. At least one of the first coupler or the frame includes a magnet configured to either retain the body portion at the first angle with respect to the frame, and so the rotating includes applying a threshold rotational force to overcome a magnetic force of the magnet, or to repel the body portion from the first angle towards the second angle.

In some embodiments of the method, the first angle is within the range of about 30 degrees to about 60 degrees, and the rotating includes rotating the first coupler more than 90 degrees and up to about 150 degrees. In some embodiments of the method, the frame is included in a wearable electronic device, and the first coupler includes a band attached to the body portion. The band can be configured to retain the wearable electronic device to a user after the rotating.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "reversible," "reversibly," and/or the like when used to described a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially non-parallel" is intended to convey that, although a non-parallel geometric relationship is desirable, some parallelism can occur in a "substantially non-parallel"

arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

While numerical ranges may be provided for certain quantities, it is to be understood that these ranges can include all subranges therein. Thus, the range "from 5 to 80" includes all possible ranges therein (e.g., 6-79, 7-78, 8-77, 9-76, . . . , 42-44, etc.). Furthermore, all values within a given range may be an endpoint for the range encompassed thereby (e.g., the range 5 to 80 includes the ranges with endpoints such as 50-80, 5-25, etc.).

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein. Further, although methods have been described herein in reference to a specific embodiment, the methods can be executed using any suitable device embodiment described herein.

For example, although the coupler 100 has been illustrated and described herein as including a channel 130 that includes a conical portion 132 and a cylindrical portion 134, in other embodiments, the channel can be differently shaped. For example, in some embodiments, the channel can be conical along substantially an entirety of the length there, or the channel can be cylindrical along substantially an entirety of the length thereof. In another example, the channel can have a first portion that is cylindrical with a first radius and a second portion that is cylindrical with a second radius different (e.g., greater than) the first radius, or have a first portion that is conical and a second portion that is conical but having a greater maximum radius than a maximum radius of the first portion. Similarly, although the coupler 320 of the frame 310 has been illustrated and described herein as being an elongated post with a conical portion 322 and a cylindrical portion 324, in other embodiments, the elongated post can be differently shaped, such as being conical along substantially an entirety of a length thereof, or being cylindrical along substantially and entirety of a length thereof. In another example, the elongated post can have a first portion that is cylindrical with a first radius and a second portion that is cylindrical with a second radius different (e.g., greater than) the first radius, or have a first portion that is conical and a second portion that is conical but having a greater maximum radius than a maximum radius of the first portion.

In another example, although the attachment portion 150 is illustrated and described herein as including an opening through which a band can be looped, in other embodiments, the attachment portion 150, 550 can be differently configured. For example, an attachment portion according to an embodiment can include a buckle, mating snaps, a zipper, a hook-and-loop fastener, or any other suitable fastener configured to couple an end portion of a band to the coupler.

In yet another example, although the magnets 108, 302 are illustrated and described herein as being substantially centrally positioned with respect to the coupler 100 and frame 310, respectively, between the first end of the channel or elongate post, respectively, and the second end of the channel or elongate post, respectively, in other embodiments, a coupler and/or frame according to embodiments can include one or more magnets having a different position. For example, a frame can include a magnet positioned proximate the conical portion of the elongate post. In another example, the elongate post can include a magnet (in lieu of or in addition to magnet 302 on frame 310). In another example, a coupler can include a magnet (in lieu of or in addition to magnet 108 of coupler 100) that is positioned within the channel 130, such as in the conical portion of the channel or the cylindrical portion of the channel.

Figure 18:
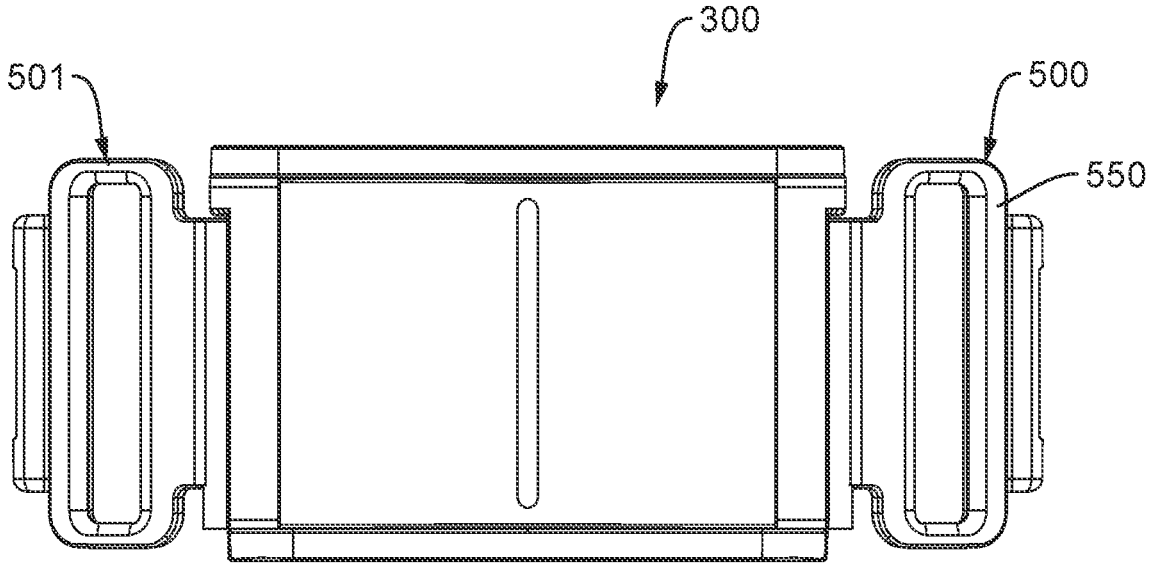
FIG. 18 is a top view of an apparatus according to an embodiment coupled to the electronics module of FIG. 6.

The specific configurations of the various components described herein can also be varied. For example, the size and specific shape of the various components can be different from the embodiments shown, while still providing the functions as described herein. For example, as shown in FIG. 18, in some embodiments, an apparatus 500 according to an embodiment can include a coupler that is similar in many respects or substantially identical to coupler 100 described herein, except that an attachment portion 550 of the coupler 500 has a different width. The attachment portion 550 of the coupler 500 shown in FIG. 18 has a width (taken along a line substantially parallel to a longitudinal axis of the a channel of the coupler 500, not shown in FIG. 18) that is greater than a width of the attachment portion 150 of the coupler shown in FIGS. 2-4. For example, the attachment portion 150 can be configured to receive a band (e.g., band 400) having a width of about 0.75 inches and the attachment portion 550 can be configured to receive a band (e.g., band 400) having a width of about 1.0 inches. As shown in FIG. 18, a second coupler 501 can be a substantially identical mirror-image of the coupler 500, and thus can be similar in many respect or substantially identical to coupler 101, which is a substantially identical mirror-image of coupler 100.

Each coupler 100, 500 is configured to be reversibly coupled to the frame 310 of the electronics module 300, as body portions 110, 510 thereof and curved side portions 120, 520 thereof can be substantially identical in shape and size, regardless of the shape and size of the respective attachment portion 150, 550. In this manner, a coupler 100, 500 with a particularly sized attachment portion can be selected to accommodate a band having a desired width for attachment to an electronics module 300 of a wearable electronic device.

The devices described herein, and various components thereof, can be constructed of any suitable material. For example, in some embodiments, the coupler 100, 500, frame 310, or other portion of a device herein can be at least partially constructed of metal, plastic or another suitable material.

Additionally, the relative size of various components of the devices shown and described herein with respect to the size of other components of the devices are not necessarily to scale.

Similarly, where methods and/or events described above indicate certain events and/or procedures occurring in certain order, unless the context clearly dictates otherwise, the ordering of certain events and/or procedures may be modified. While the embodiments have been particularly shown and described, it will be understood that various changes in form and details may be made.

What is claimed is:

1. An apparatus, comprising:

a coupler configured to be removably coupled to a frame, the coupler including a body portion and a curved side portion disposed along a side of the body portion, the curved side portion defining a channel configured to slidingly receive an elongated post of the frame, the curved side portion including a first portion disposed on a first side of the channel and a second portion disposed on a second side of the channel opposite the first side of the channel, the body portion and the curved side portion collectively having an end profile in which a surface portion of the first portion of the curved side portion that extends to the channel is coplanar with a plane of an adjacent surface of the body portion and at least a portion of the second portion of the curved side portion intersects the plane, the end profile configured to prevent insertion of the elongated post of the frame into the channel unless the body portion of the coupler is positioned at an angle with respect to the frame that is within the range of about 5 degrees to about 80 degrees with respect to the frame.

2. The apparatus of claim 1, wherein the angle is about 40 degrees to about 60 degrees.

3. The apparatus of claim 1, wherein the second portion of the curved side portion terminates in an externally facing end face.

4. The apparatus of claim 1, wherein:

an end face of a free end of the curved side portion defines a cut-out portion between a first end of the curved side portion and a second end of the curved side portion, the cut-out portion positioned between the first end of the curved side portion and the second end of the curved side portion to receive a bar of the frame when the elongated post is in a fully inserted position in the channel, the bar of the frame is substantially perpendicular to the elongated post.

5. The apparatus of claim 1, wherein the angle is a first angle, the channel of the coupler has a substantially semi-cylindrical cross-sectional profile that permits the coupler to rotate with respect to the frame and about the elongated post when the elongated post is received in the channel so that the body portion of the coupler is configured to be positioned at a second angle with respect to the frame, the second angle is within the range of about 120 degrees and to about 180 degrees, the apparatus further comprising:

a magnet coupled to the surface of the body portion of the coupler, the magnet configured to produce a magnetic force to one of (1) retain the coupler at the first angle relative to the frame in the absence of a threshold rotational force when the elongated post of the frame is slidingly received in the channel, or (2) repel the body portion of the coupler from being positioned at the first angle with respect to the frame towards the second angle with respect to the frame when the elongated post of the frame is slidingly received in the channel.

6. The apparatus of claim 1, further comprising:

a magnet coupled to the body portion of the coupler, the magnet configured to produce a magnetic force that attracts a magnet coupled to the frame to help slidingly move the elongated post of the frame through the channel to a fully inserted position, the magnetic force produced by the body portion of the coupler prevents, at least in part, withdrawal of the elongated post from the channel in the absence of a threshold translational force.

7. The apparatus of claim 1, wherein a first portion of the channel is substantially conical and a second portion of the channel is substantially cylindrical and mutually exclusive of the first portion of the channel, the first portion of the channel is continuous with the second portion of the channel, the conical portion of the channel configured to receive a conical portion of the elongated post of the frame.

8. The apparatus of claim 1, wherein:

the curved side portion terminates in an end face disposed on a second side of the channel opposite the first side, the end face is substantially planar, the surface of the body portion is non-parallel with the end face of the curved side portion.

9. The apparatus of claim 1, wherein the frame is a frame of a wearable electronic device and the side of the body portion is a first side, the coupler further comprising:

an attachment portion disposed on a second side of the body portion, the attachment portion configured to be attached to a band for wearing the wearable electronic device.

10. An apparatus, comprising:

a first coupler having a body portion and a curved side portion disposed on a side of the body portion, the curved side portion defining a channel extended from a first end of the curved side portion to a second end of the curved side portion opposite the first end, the curved side portion including a first portion disposed on a first side of the channel and a second portion disposed on a second side of the channel opposite the first side of the channel, the first portion of the curved side portion including a planar surface that is coplanar with a planar surface of the body portion adjacent to the planar surface of the first portion of the curved side portion, the second portion of the curved side portion including an externally facing end face, the end face being planar, the channel configured to removably receive a second coupler of a frame, the first coupler configured to be in a first position relative to the second coupler when the second coupler of the frame is received in the channel and the body portion is positioned at a first angle with respect to the frame, the first coupler configured to be rotated about the second coupler of the frame from the first position to a second position relative to the second coupler, the body portion configured to be positioned at a second angle with respect to the frame when the first coupler is in the second position, the curved side portion of the first coupler configured to prevent removal of the second coupler from the channel when the first coupler is in the second position.

11. The apparatus of claim 10, wherein the first coupler is configured to be rotated about the second coupler to the second position only when the second coupler is fully inserted into the channel.

12. The apparatus of claim 10, further comprising:

a magnet coupled to the body portion of the coupler, the magnet configured to produce a magnetic force to retain the second coupler of the frame in the channel absent a threshold translational force to separate the second coupler from the channel of the first coupler.

13. The apparatus of claim 10, wherein the first angle is within the range of about 40 degrees to about 60 degrees.

14. The apparatus of claim 10, wherein the second angle is greater than the first angle and up to about 180 degrees.

15. The apparatus of claim 10, wherein a first portion of the channel is substantially conical and a second portion of the channel is substantially cylindrical and mutually exclusive of the first portion of the channel, the first portion of the channel is continuous with the second portion of the channel, the conical portion of the channel configured to receive a conical portion of the second coupler when the second coupler is fully inserted into the channel.

16. The apparatus of claim 10, wherein the frame is included in a wearable electronic device, the first coupler including an attachment portion on a side of the body portion opposite the channel, the attachment portion configured to be attached to a band for wearing the wearable electronic device.

17. A method, comprising:

positioning a planar outer surface of a body portion of a first coupler at a first angle with respect to a planar surface of a frame, the first angle being about zero degrees;

slidingly translating a channel defined by the first coupler over a second coupler of the frame, until the second coupler is fully received into the channel, the planar outer surface of the body portion of the first coupler being at the first angle with respect to the planar surface of the frame during the translating; and rotating, after the translating, the first coupler about the second coupler so that the planar outer surface of the body portion of the first coupler is at a second angle with respect to the planar surface of the frame, the second angle being greater than the first angle, the first coupler being non-removable from the second coupler when the body portion is at the second angle with respect to the frame.

18. The method of claim 17, wherein the first coupler includes a curved side portion that extends from a side of the body portion, the curved side portion defines the channel and includes a planar surface that extends from the body portion to the channel.

19. The method of claim 17, wherein the rotating includes rotating the first coupler more than 90 degrees.

20. The method of claim 17, further comprising:

moving, after the rotating, a locking clip from a first position, in which the locking clip does not interfere with rotation of the first coupler with respect to the second coupler, to a second position in which the locking clip prevents the first coupler from being positioned at the first angle with respect to the frame.

* * * * *